US005262286A

United States Patent [19]

Bacilek et al.

[11] Patent Number: 5,262,286

[45] Date of Patent: Nov. 16, 1993

[54] REDUCTION OF YELLOW STAIN IN PHOTOGRAPHIC PRINTS

[75] Inventors: John F. Bacilek, Rochester; Gary J. McSweeney, Hilton, both of N.Y.

[73] Assignee: Eastman Kodak Company, Rochester, N.Y.

[21] Appl. No.: 922,928

[22] Filed: Jul. 31, 1992

[51] Int. Cl.[5] ..... G03C 1/35

[52] U.S. Cl. ..... 430/362; 430/376; 430/390; 430/504; 430/517; 430/543; 430/549; 430/559

[58] Field of Search ..... 430/362, 376, 377, 390, 430/504, 517, 543, 548, 549, 559

[56] References Cited

U.S. PATENT DOCUMENTS

| | | | |
|---|---|---|---|
| 3,178,285 | 4/1965 | Anderau et al. | 430/503 |
| 3,442,781 | 5/1969 | Weinberger | 430/32 |
| 3,574,623 | 4/1971 | Williams | 430/504 |
| 3,676,175 | 7/1972 | Woodward | 428/412 |
| 3,802,881 | 4/1974 | Land et al. | 430/220 |
| 3,833,380 | 9/1974 | Crawford et al. | 430/504 |
| 3,837,854 | 9/1974 | Waxman et al. | 430/214 |
| 3,853,562 | 12/1974 | Land et al. | 430/449 |
| 3,996,050 | 12/1976 | Land | 430/220 |
| 4,145,480 | 3/1979 | Kusama et al. | 430/513 |
| 4,169,188 | 9/1979 | Nagai et al. | 428/513 |
| 4,197,123 | 4/1980 | Oetiker et al. | 430/300 |
| 4,345,074 | 8/1982 | Hufnagel et al. | 544/99 |
| 4,347,284 | 8/1982 | Tsutomu et al. | 428/328 |
| 4,396,671 | 8/1983 | Wanka et al. | 428/323 |
| 4,563,406 | 1/1986 | Ohbayashi et al. | 430/513 |
| 4,868,087 | 9/1989 | Yamamoto | 430/138 |
| 4,942,114 | 7/1990 | Shiba et al. | 430/434 |
| 4,980,274 | 12/1990 | Tai et al. | 430/533 |
| 5,098,820 | 3/1992 | McManus et al. | 430/517 |

FOREIGN PATENT DOCUMENTS

| | | |
|---|---|---|
| 664854 | 6/1963 | Canada . |
| 3031444 | 3/1981 | Fed. Rep. of Germany . |
| 55-93150 | 7/1980 | Japan . |
| 361873 | 5/1930 | United Kingdom . |

OTHER PUBLICATIONS

Chemical Abstract #92659p, vol. 71, 1969, p. 78 and cover sheet of French Patent 1,530,578.

Chemical Abstract #188640x, vol. 95, 1981, p. 76.

Chemical Abstract #17122e, vol. 94, and cover sheet of European Patent 0 014 678.

Chemical Abstract #188640x, vol. 95, 1981, p. 76, and Japanese Publication J5/9072-442.

Chemical Abstracct #130899e, vol. 109, 1988, p. 89, and European Patent Application 0 271 403 (Tables 1-4, Examples 18-20, Comparative Examples 1-3, & Claims 1-9).

Chemical Abstract #151564g, vol. 109, and Japanese Publication 63-130672.

*Primary Examiner*—Hoa Van Le

*Attorney, Agent, or Firm*—Paul A. Leipold

[57] ABSTRACT

The invention is generally accomplished by providing a reflection print material having thereon sensitized silver halide containing layers and at least one layer comprising at least one insoluble colored tint, wherein said at least one tint changes the color of said material to be less yellow. In a preferred form, it has been found that a combination of two tints is preferred to provide ready adjustment of the tinting to match the yellowing characteristics of the print material.

15 Claims, 2 Drawing Sheets

REDUCTION OF YELLOW STAIN IN PHOTOGRAPHIC PRINTS

FIELD OF THE INVENTION

The invention relates to formation of color photographic prints. In particular, it relates to the control of yellow stain in these prints.

BACKGROUND OF THE INVENTION

It is known in the photographic art to form color prints. Such color prints generally are formed in conventional photographic color paper by exposure of a resin coated paper that has been coated with emulsion layers of cyan, magenta, and yellow couplers. After exposure the color paper is developed to form the print. In formation of such materials it is known that the couplers, UV absorbers, retained dyes and other components of the photographic element have a yellow component that may result in staining of the photographic print with a yellowish stain.

Generally, it has been the practice in resin coated papers to incorporate dyes or pigments into the resin coating layers of the paper to counteract the yellow stain and result in a whiter print.

It is disclosed in U.S. Pat. No. 3,802,881—Land et al, U.S. Pat. No. 3,853,562—Land et al, and U.S. Pat. No. 3,996,050—Land et al that pigments may be incorporated in the processing layer of an instant photographic structure to result in whitening of instant prints.

In the formation of color prints having a polymer sheet as base material, it has not been practical to incorporate color tints into the base during formation. Therefore, color prints formed on polymer base material have had a particular problem with yellow stain.

There is also a difficulty in incorporation of color tints into the photographic base paper in that the paper may be used for different products that have different stain characteristics, and the color correcting pigments in a particular paper may not be suitable for the stain of all emulsions utilized with it.

Therefore, there is a need to provide a method of neutralizing or counteracting yellow stain in reflection print materials formed on a polymer base, and also to provide an improved system for control of color stain in materials coated on a paper base.

THE INVENTION

An object of the invention is to overcome disadvantages of prior products.

It is an object of the invention to provide color prints having reduced yellow stain.

It is another object of the invention to provide improved color prints on polymer base materials.

These and other objects of the invention are generally accomplished by providing a reflection print material having thereon sensitized silver halide containing layers and at least one layer comprising at least one insoluble colored tint, wherein said at least one tint changes the color of said material to be less yellow. In a preferred form, it has been found that a combination of two tints is preferred to provide ready adjustment of the tinting to match the yellowing characteristics of the print material.

DETAILED DESCRIPTION OF THE INVENTION

Figure 1:
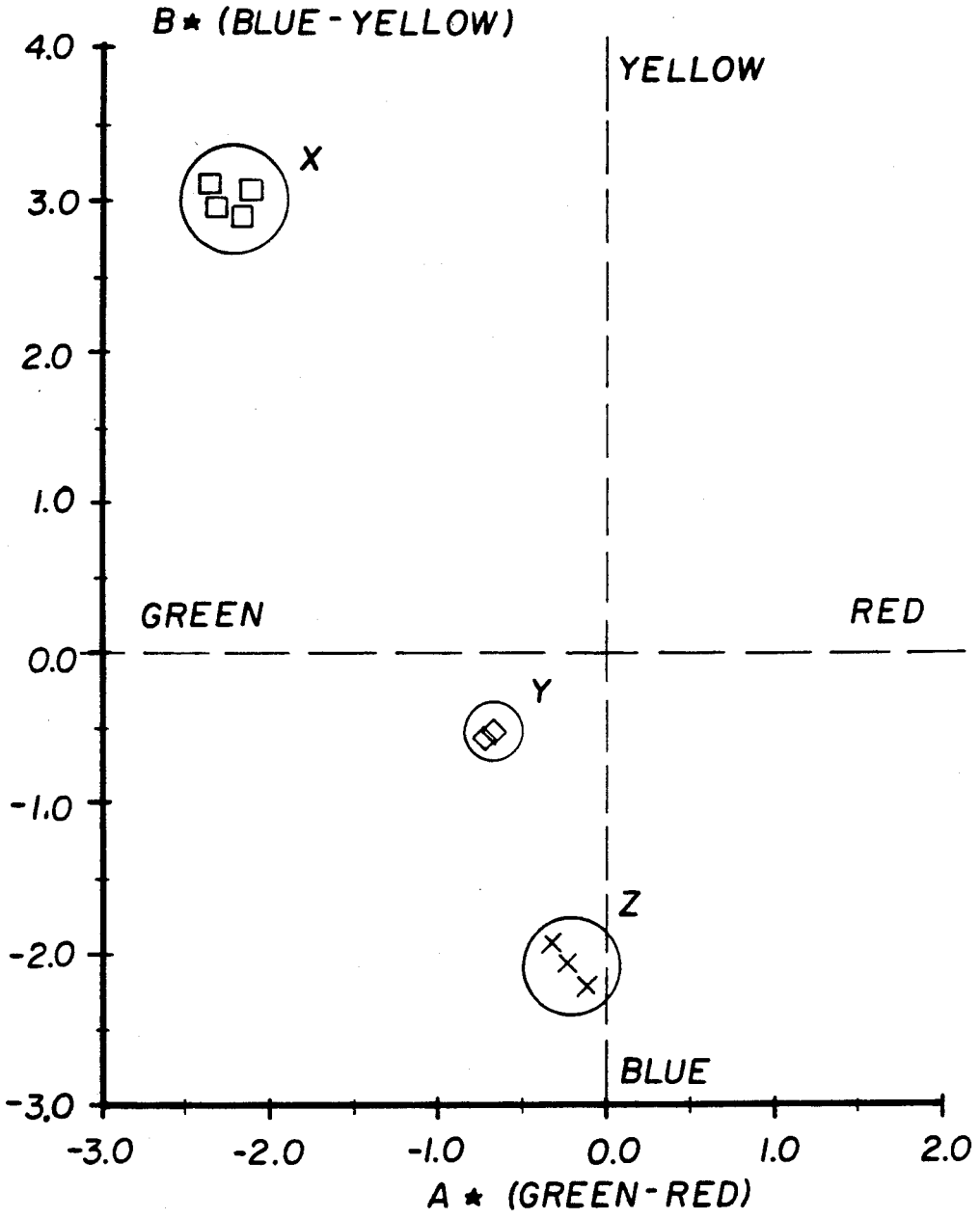
FIG. 1 illustrates the colorimetric plot of Examples 1-3.

The invention has numerous advantages over prior products. The invention allows reflection prints to be formed on print material with correction for yellow stain. Further, the invention has the advantage that the amount of yellow neutralizing or correction may be controlled by regulation of the amount of counteracting tints added during the photographic element formation. Further, the tints themselves may be modified in mixture so as to provide the right amount of yellowing correction for the product into which they are incorporated. The invention also allows the adjustment of tinting to be conducted as a product is laid down rather than being limited to a base with particular yellow stain correction. These and other advantages will be apparent from the detailed description below. In the invention, a reflective print element on a base sheet is sensitized with silver halide containing layers, and then at least one layer comprising at least one insoluble tint is incorporated into the element. It is preferred that the incorporation be in a layer between emulsion layers. In conventional color print material, there is at least one layer of cyan, at least one layer of magenta, and at least one layer of yellow coupler. It is possible to incorporate the tint into one of the coupler layers or as a sub layer between the first emulsion layer and the base. However, it is preferred that it be incorporated as an interlayer between emulsion layers because emulsion layers can have a varying flow to control the contrast of the finished product. If the tints are incorporated into an interlayer, the flow may be maintained constant to provide a constant tint.

The tint, in order to overcome yellow stain, have a blue color. The amount of blue added corresponds to that required to counteract the yellow stain and produce a generally neutral color that the eye sees as white.

It has been found that by balancing the concentration of two pigments or dyes, a wide range of yellow stain correction may be achieved. Generally, one dye or pigment tends to be a blue that has a color shifted towards the magenta, while the other is a blue with the color shifted towards the cyan. Blending of such materials allows a wide range of color corrections to best balance various densities and color characteristics of the yellow stain.

The tinting materials utilized in the invention may be any pigment that is not water soluble such that it would be removed during processing. Further, the particle size must be small enough so that it does not contribute to the grain of the color print. Generally, a particle size of between about 0.5 and about 30 microns has been found to be preferred for effective tinting without contribution to grain. Further, the color pigment particles must be smaller than the layer in which they are incorporated or else they will cause surface distortion problems during coating. Further, it is important that the tint materials not interact with the photographic materials during coating, processing, or storage. Particular preferred materials have been found to be the pigments set forth below.

Compound A:

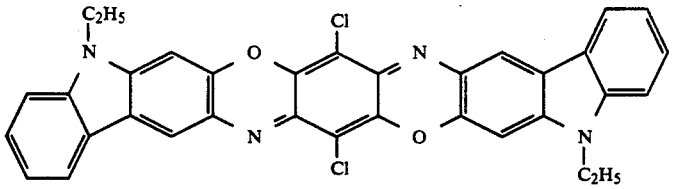

Compound B:

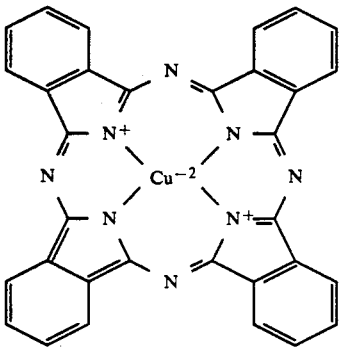

The effectiveness of the invention may be shown by the examination of FIG. 1 which is representative of the three examples set forth below. As illustrated in FIG. 1, the area represented by "X" is where samples from Example 1 were shown to exist in the color space. The area represented by "Y" is representative of the color space of Example 2 where the color space is close to neutral. The area of "Z" is representative of the color space of samples of Example 3. It is noted that the area of both Y and Z is considered satisfactory, as the slightly blue color apparently is preferred by most people for a white. Therefore, while the invention discusses neutralizing or counteracting the yellow stain to produce a white it is actually intended in the practical sense to produce a slightly blue color (the white people like) with a very small or no amount of green or red. It is understood that the position without tint would be different than that shown by the "X" area for different products. If the yellow stain was in a different color space, it would be necessary to adjust the tint amount to provide the proper shift to result in a print in the general area of "Z" and "Y". This invention is suitable for use with color print material of any composition. Typically, color prints are formed on a paper base which may be resin treated or on a polymer base. Generally, the polymer treated paper is coated with polyethylene layers. These layers in commercial papers are generally provided with a tint to result in a paper with neutralizing of the yellow stain. The invention may be utilized with coated papers that do not have the tints in the resin layers, or the invention may be utilized with papers having tints in the resin layers to provide further color correction for specific emulsions for which the papers were not intended. The invention finds its preferred use with polymer base materials such as polyester sheets. These polyester sheets ordinarily do not incorporate colored tinting materials and, therefore, there is a desire to provide tinting of reflection prints on these materials to shift the yellow to slightly blue and reduce yellow stain.

Figure 2:
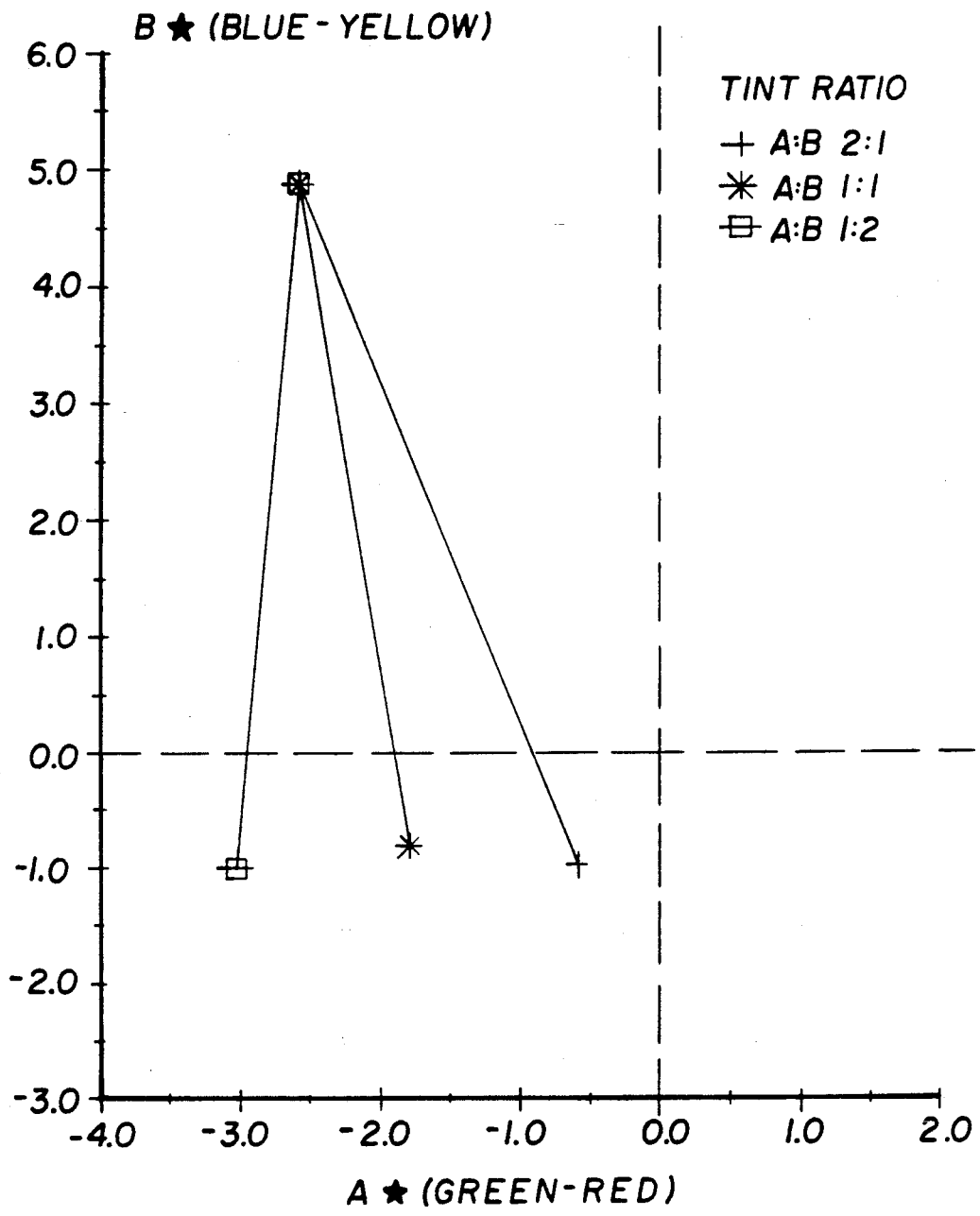
FIG. 2 illustrates the effect of varying the ratio of 2 tints, as well as the effect of increasing the concentration of the tints on color correction.

In FIG. 2 is illustrated a comparison of the change in tint correction as the amount of two tints in accordance with the invention is varied. The A tint is a magenta blue, whereas the B tint tends to be a more cyan blue. Illustrated is varying the ratio of these tints from 2 to 1 to 1 to 2 and as can be seen, a wide range of tint correction is possible to reach the desired slightly blue neutral range. FIG. 2 was developed from the variation of tint correction in a actual color print. As the test was performed on an actual color print, it should be understood that the starting point of the lines corresponds to that color print's yellow stain. If a different type of color print was utilized, the general slope of the lines would be the same; however, the starting point of the lines would be different. For instance, if there was less yellow stain but the position on the green red line was the same, the starting point would move down on the graph, but the slopes of the lines would remain essentially the same. It is noted that the lower portions of the line in each case are those containing greater amounts of tint. Points with only small changes from the starting point have lesser amounts of tint.

The invention may be utilized with any emulsion and coupler combinations that are utilized for reflected color prints. The invention further is suitable for use with color prints containing any of the conventional additives such as UV absorbers, stabilizers, absorbing dyes, biostats, antistatic agents, and scavengers. The general compositions of reflective color prints are well known, and the invention is believed to be suitable for use with any conventional color print material. The examples below are intended to be representative and not exhaustive of articles formed in accordance with the invention.

EXAMPLE 1 (Control)

A light sensitive color negative paper emulsion structure is coated on a pigmented polyester support to be used for forming color photographic images of exceptional durability. In Table 1, the gelatin, silver, and coupler laydowns of seven layers in a multilayer hopper coating are shown.

TABLE 1

| (Laydowns in grams/meter squared) | Gelatin | Silver | Coupler | Tint A | Tint B |
|---|---|---|---|---|---|
| Protective Overcoat | 1.345 | 0.000 | 0.000 | | |
| UV Filter Layer* | 0.700 | 0.000 | 0.000 | | |
| Red Sensitive Layer | 1.076 | 0.335 | 0.423 | | |
| UV Filter Layer* | 0.700 | 0.000 | 0.000 | | |
| Green Sensitive Layer | 1.238 | 0.396 | 0.423 | | |
| Interlayer | 0.753 | 0.000 | 0.000 | 0.00000 | 0.00000 |
| Blue Sensitive Layer | 1.507 | 0.359 | 1.076 | | |

*85 percent U and 15 percent V

The photographic element of Table 1 is treated to form a colored image. The element is exposed to a tungsten source which was attenuated by selective filters to render three individual separation exposures to red, green, and blue light. The element is then treated in a conventional wet process with color developing agent to form individual color separation images. Subsequently, the residual silver halide is removed by a conventional wet bleach/fix solution to leave a cyan, magenta, and yellow dye image.

An unexposed (white) area of the photographic image is selected and tested on a Spectrogard Colorimeter. This instrument is used to measure the lightness and hue of whites by means of the CIE LAB specification. This specification results in three quantitative evaluations of a "white":

L* is a specification of the lightness of a white (wherein a higher value represents a lighter white and a lower value represents a darker white).

a* is a specification of hue (wherein a higher value represents a warmer or redder hue and a lower value represents a colder or greener hue).

and b* is also a specification of hue(wherein a higher value represents a yellower hue and a lower value represents a bluer hue).

The CIE LAB measurements for Example 1 are shown in Table 4 along with the measurements for the subsequent examples, and are also represented by area X on FIG. 1.

EXAMPLE 2

In this example a photographic element is prepared and treated exactly as in Example 1, except that included in the layer between the blue and green sensitive layers, tint A and tint B were included at the laydowns shown in Table 2.

TABLE 2

| (Laydowns in grams/meter squared) | Gelatin | Silver | Coupler | Tint A | Tint B |
|---|---|---|---|---|---|
| Protective Overcoat | 1.345 | 0.000 | 0.000 | | |
| UV Filter Layer* | 0.700 | 0.000 | 0.000 | | |
| Red Sensitive Layer | 1.076 | 0.335 | 0.423 | | |
| UV Filter Layer* | 0.700 | 0.000 | 0.000 | | |
| Green Sensitive Layer | 1.238 | 0.396 | 0.423 | | |
| Interlayer | 0.753 | 0.000 | 0.000 | 0.00092 | 0.00057 |
| Blue Sensitive Layer | 1.507 | 0.359 | 1.076 | | |

*85 percent U and 15 percent V

The CIE LAB measurements of this example are shown in Table 4, and are represented by area Y on FIG. 1.

EXAMPLE 3

In this example a photographic element is prepared and treated exactly as in Examples 1 and 2, except that levels of Tint A and Tint B were higher than in Example 2 as shown in Table 3.

TABLE 3

| (Laydowns in grams/meter squared) | Gelatin | Silver | Coupler | Tint A | Tint B |
|---|---|---|---|---|---|
| Protective Overcoat | 1.345 | 0.000 | 0.000 | | |
| UV Filter Layer* | 0.700 | 0.000 | 0.000 | | |
| Red Sensitive Layer | 1.076 | 0.335 | 0.423 | | |
| UV Filter Layer* | 0.700 | 0.000 | 0.000 | | |
| Green Sensitive Layer | 1.238 | 0.396 | 0.423 | | |
| Interlayer | 0.753 | 0.000 | 0.000 | 0.00138 | 0.00085 |
| Blue Sensitive Layer | 1.507 | 0.359 | 1.076 | | |

*85 percent U and 15 percent V

The CIE LAB measurements of this example are shown in Table 4, and are represented by area Z on FIG. 1.

TABLE 4

| (CIE LAB Measurements of Examples) Element of | l* | a* | b* |
|---|---|---|---|
| Example 1 | 96.88 | −2.21 | 3.05 |
| Example 2 | 94.44 | −0.70 | −0.54 |
| Example 3 | 93.41 | −0.22 | −2.07 |

As we can see in these examples, and as illustrated in FIG. 1, if we add more tint A and tint B to the layer between the green and the blue sensitive layers, we cause the white areas of our image to become redder (higher a*), bluer (lower b*), and darker (lower L*). Elements like Examples 2 and 3 form a much more preferable white image in photographic prints than do elements like Example 1.

Magenta Coupler

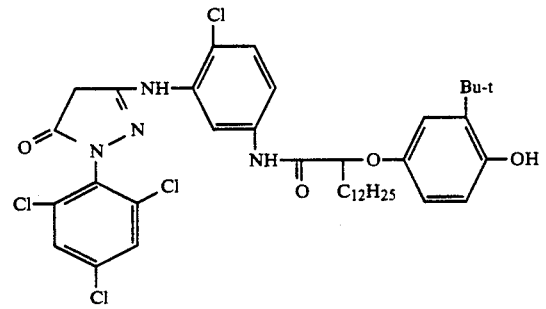

Yellow Coupler

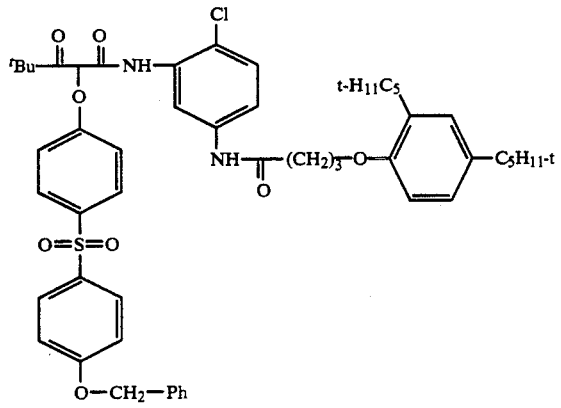

Cyan Coupler

-continued

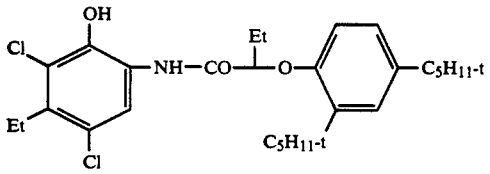

UV Absorbers (U)

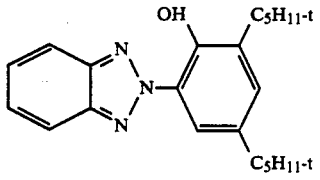

UV Absorbers (V)

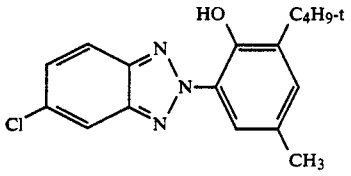

Magenta Stabilizer

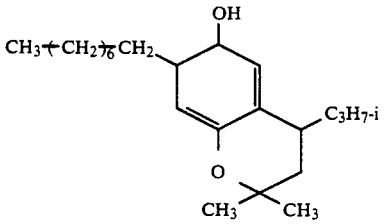

The invention has been described in detail with particular reference to preferred embodiments thereof, but it will be understood that variations and modifications can be effected within the spirit and scope of the invention.

We claim:

1. A reflection print element comprising a base, sensitized silver halide containing layers, and at least one layer comprising at least one water insoluble color tint, wherein said at least one tint changes the color of said material to be less yellow, comprises a particle size between about 0.5 and about 30 microns, and wherein said at least one tint comprises a mixture of Compound A:

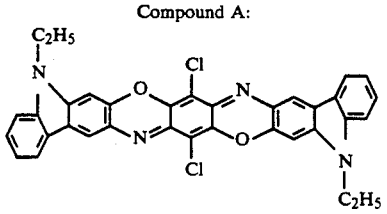

and

Compound B:

-continued

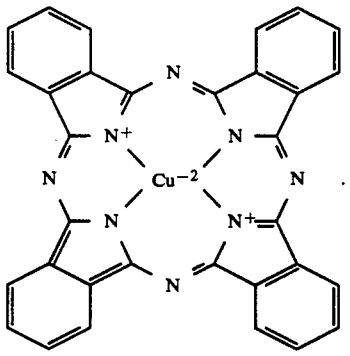

2. The element of claim 1 wherein said at least one layer is an interlayer between emulsion layers of said element.

3. The element of claim 1 wherein said element has an A* of −0.4 and B* of −1.6.

4. The element of claim 1 wherein said A* is between about −2 and about +2, and B* is between about −3 and about +1.

5. The element of claim 1 wherein said mixture comprises between 0.5 and 2.0 parts by weight A to 1 part by weight B.

6. The element of claim 1 wherein said base comprises a polymer sheet.

7. The element of claim 1 wherein said base comprises resin coated paper.

8. The element of claim 1 wherein said at least one layer is between said base and an emulsion layer.

9. A method of reducing yellow stain in photographic print materials by providing at least one layer in said print material comprising at least one water insoluble color tint, wherein said at least one tint changes the color of said material to be less yellow, said tint comprises a particle size of between about 0.5 and 30 microns, and wherein said at least one tint comprises a mixture of Compound A:

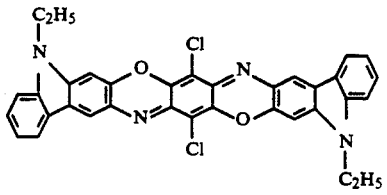

and

Compound B:

-continued

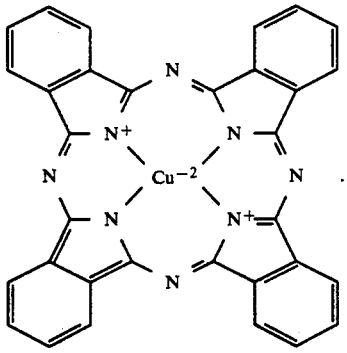

10. The method of claim 9 wherein said at least one layer is an interlayer between emulsion layers of said print material.

11. The method of claim 9 wherein said print material has an A* of −0.4 and B* of −1.6.

12. The method of claim 9 wherein said print material has an A* between about −2 and about +2, and B* between about −3 and about +1.

13. The method of claim 9 wherein said mixture comprises between 0.5 and 2.0 parts by weight A to 1 part by weight B.

14. The method of claim 9 wherein the base of said print material comprises a polymer sheet.

15. The method of claim 9 wherein the base of said print material comprises resin coated paper.

* * * * *